US006274027B1

(12) United States Patent
Kiya et al.

(10) Patent No.: US 6,274,027 B1
(45) Date of Patent: Aug. 14, 2001

(54) METHOD OF DESCALING TITANIUM MATERIAL AND DESCALED TITANIUM MATERIAL

(75) Inventors: Shigeru Kiya; Takashi Shibata; Shingo Iwasaki; Hayato Kita, all of Joetsu; Masanori Takahashi, Niigata, all of (JP)

(73) Assignee: Sumitomo Metal Industries, LTD, Osaka (JP)

( * ) Notice: Subject to any disclaimer, the term of this patent is extended or adjusted under 35 U.S.C. 154(b) by 0 days.

(21) Appl. No.: 09/347,919

(22) Filed: Jul. 6, 1999

(51) Int. Cl.[7] ..... C25F 1/08

(52) U.S. Cl. ..... 205/705; 205/709; 205/710; 205/723

(58) Field of Search ..... 205/705, 709, 205/710, 723

(56) References Cited

U.S. PATENT DOCUMENTS 4,406,761 * 9/1983 Shimogori et al. ..... 205/709
5,712,046 * 1/1998 Kamidaira et al. ..... 205/73

FOREIGN PATENT DOCUMENTS 56-156799 12/1981 (JP) .
60-194099 * 10/1985 (JP) .
61-117292 6/1986 (JP) .
2-310399 12/1990 (JP) .
3-247785 11/1991 (JP) .

OTHER PUBLICATIONS

Abstract of U.S. Patent No. 4,026,777 of May 31, 1977 (Please note that a full copy of the patent should be available to the examiner).

* cited by examiner

*Primary Examiner*—Arun S. Phasge
(74) *Attorney, Agent, or Firm*—Armstrong, Westerman, Hattori, McLeland & Naughton, LLP

(57) ABSTRACT

A method of descaling titanium material including the steps of immersing titanium material having oxide scale on a surface thereof in a fused alkaline salt bath in accordance with needs; subjecting the titanium material to anodic electrolysis or alternate electrolysis in an electrolyte solution so as to dissolve the oxide scale; and subjecting the titanium material to acid pickling so as to remove remaining oxide scale or oxide film generated in the electrolysis.

11 Claims, 3 Drawing Sheets

Fib.2(c)

Fib.3
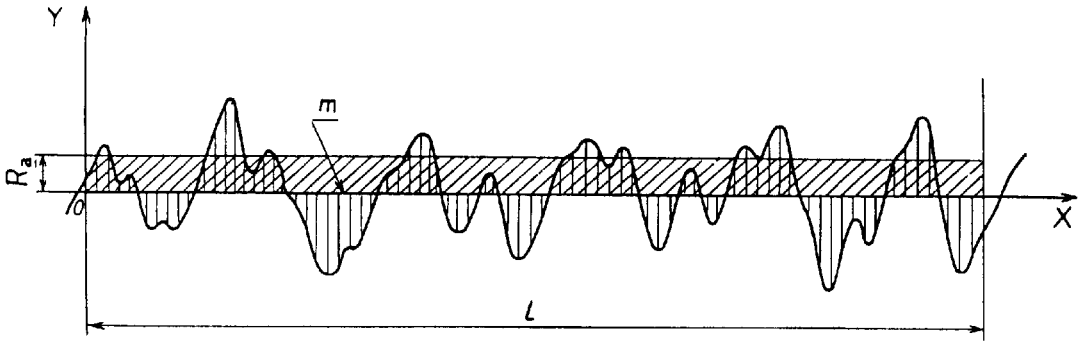

METHOD OF DESCALING TITANIUM MATERIAL AND DESCALED TITANIUM MATERIAL

BACKGROUND OF THE INVENTION

1. Field of the Invention

The present invention relates to a method of removing oxide scale generated on the surface of titanium material and descaled titanium material.

2. Description of the Related Art

In manufacture of plates, tubes, bars, and wires from titanium or titanium alloy (hereinafter collectively called "titanium material"), oxide scale generated on the surface of the material in the process of annealing or a like step is required to be removed. The most commonly used method of removing scale is a method in which titanium material is subjected to acid pickling by use of a mixed acid solution composed of nitric acid and hydrofluoric acid (hereinafter referred to as "nitric-hydrofluoric acid pickling solution").

However, if scale is thick, or in a case where thick scale is generated on a titanium plate in the process of annealing performed after hot rolling, the scale cannot be completely removed merely through acid pickling by use of a nitric-hydrofluoric acid pickling solution. Therefore, for example, descaling of a titanium plate having a thickness of 3 mm or more is often performed according to a method in which the plate is subjected to acid pickling after a mechanical descaling treatment such as shot blast treatment.

As in the case of ordinary stainless steel strips, cold-rolled titanium strips are successively subjected to annealing and descaling in a successive annealing-pickling line in order to improve production efficiency.

Generally, an annealing furnace is a combustion furnace of a tunnel type which employs hydrocarbon gas as fuel. Since a strip is heated to about 700–800° C. while being passed through the interior of the furnace, oxide scale is generated on the surface of the strip. For removal of the oxide scale from the surface of the strip after annealing, the strip is first immersed in a fused alkaline salt bath, and then subjected to acid pickling by use of a nitric-hydrofluoric acid pickling solution.

Since a cold-rolled titanium strip generally has a relatively small thickness of 2 mm or less, if the strip is subjected to a mechanical descaling treatment such as shot blast treatment, large residual deformation or warp is imparted to the strip. Therefore, the strip is subjected to a fused alkaline salt bath treatment instead of a mechanical treatment.

Fused alkaline salts generally used in such a salt bath comprise a mixture of alkali mainly composed of sodium hydroxide and sodium nitrate, and salts, which mixture is heated and fused at 430–550° C. when used.

For example, Japanese Patent Publication (kokoku) No. 4-72914 discloses, as a method of removing oxide scale from the surface of a cold-rolled titanium plate, a method in which a plate is immersed in a fused alkaline salt bath mainly containing sodium hydroxide and an oxidizing agent; and the plate is subjected to acid pickling by use of a nitric-hydrofluoric acid pickling solution. However, in this method involving immersion of a titanium plate in a fused alkaline salt bath, sparks are likely to be generated and create flaws on the surface of the titanium plate in the bath (such flaws are hereinafter called "spark flaws").

In a fused alkaline salt bath, spark flaws are generated due to a potential difference between a titanium strip and an iron-made immersion roll for immersing the strip in the fused alkaline salt bath. In other words, a spark is discharged at the moment the titanium strip having dissolved oxide scale on its surface contacts the iron-made immersion roll so that the surface of the titanium strip is fused locally, resulting in spark flaws.

Japanese Patent Application Laid-Open (kokai) No. 3-247785 discloses a method of descaling a titanium strip in which generation of the above-described spark flaws can be prevented. In this method, a potential difference between a titanium strip and an iron-made immersion roll is reduced by means of a titanium-made sacrificial anode which forms a short circuit between the anode and the iron-made immersion roll in a fused alkaline salt bath.

In this method, however, since titanium of the sacrificial anode dissolves into the fused alkaline salt bath, deterioration of the bath is disadvantageously accelerated, and expensive titanium is wastefully consumed.

Japanese Patent Application Laid-Open (kokai) No. 4-45293 discloses a method in which generation of spark flaws is prevented by arranging above the surface of the bath an entry-side immersion roll immersed in a fused alkaline salt bath and an exit-side immersion roll.

In this method, oxide scale on the surface of the titanium plate prevents contact between the titanium plate and the entry-side immersion roll, resulting in no spark discharge, and even if oxide scale is dissolved in the bath and no oxide scale exists at the exit side of the bath, no electric cell is formed at the exit-side immersion roll since the roll is above the surface of the bath, resulting in no spark discharge.

However, this method is difficult to apply to actual operations, since the heights of immersion rolls must be regulated depending on the thickness and dissolution rate of scale. The above-described problems of generation of spark flaws hinder sufficient treatment by use of fused alkaline salts, resulting in scale remaining after descaling treatment.

Japanese Patent Application Laid-Open (kokai) No. 56-15679 discloses a method of electrolytic descaling of a titanium sheet in which a polishing tool is slid on the surface of a titanium sheet serving as an cathode, to thereby perform anodic electrolysis.

However, since this method is a method of descaling through dissolving of the titanium base metal by use of a hydrochloric acid solution serving as an electrolyte solution, the surface of a titanium sheet becomes rough after descaling, failing to produce a titanium sheet having excellent surface finish. Also, this method requires installation of a polishing tool, such as a polishing belt, in an electrolysis vessel, leading to high equipment cost.

Japanese Patent Application Laid-Open (kokai) No. 60-194099 discloses a method of removing oxide scale from titanium material through electrolytic pickling by use of an aqueous solution of nitric-hydrofluoric acid. This method aims to shorten the time required for acid pickling.

Although the time for acid pickling can be shortened by this method, expensive material such as platinum must be used for electrodes, since a nitric-hydrofluoric acid solution is highly corrosive.

Japanese Patent Application Laid-Open (kokai) No. 2-310399 discloses a method of removing oxide scale from titanium material in which electrolysis is performed while a cloth soaked with a sulfuric acid electrolyte solution is caused to contact titanium material to be treated. However, this method is established in order to immediately and safely remove oxide scale locally generated in the course of welding or a like process. If this method is applied to a titanium strip having a large area, gas generated during electrolysis assumes the form of bubbles, and the bubbles accumulate in spaces between the cloth soaked with the electrolyte solution and the surface of the titanium strip. As a result, the area of the strip in contact with the electrolyte solution is decreased so that efficiency of descaling is lowered and uniformity of descaling is lost. Therefore, surface roughness and surface gloss become disadvantageously nonuniform.

Conventionally, polishing techniques such as mechanical, chemical, and electrolytic polishings have been known for producing titanium material of a low surface roughness and excellent surface gloss. If these techniques are applied to the production of titanium material, the surface roughness of the resultant material may be as low as or lower than that of titanium material descaled by the method of the present invention. However, in order to apply these techniques, expensive equipment and chemicals are required, and high labor cost and manufacture know-how are also required, resulting in greatly increased costs in manufacture. Although rolls having a low surface roughness may be used for finish-rolling to provide titanium material with a low surface roughness, crystal grains in the material will be deformed as the reduction ratio increases, which results in hardening and poor formability of the material.

SUMMARY OF THE INVENTION

An object of the present invention is to provide a method of descaling titanium material by use of the fused alkaline salt bath method. In this method, oxide scale can be removed from the surface of a titanium material without generation of spark flaws, and excellent surface roughness is obtained after descaling.

Another object of the present invention is to provide a method of descaling in this case where a scale layer has a small thickness of about 350 nm or less. In this method, oxide scale can be removed from the surface of a titanium material in a short time without the titanium material being immersed in a fused alkaline salt bath, and excellent surface roughness is obtained after descaling.

The gist of the present invention for descaling titanium material is as follows:

(1) A method of descaling titanium material, comprises the steps of: subjecting titanium material having oxide scale on its surface to anodic electrolysis or alternate electrolysis performed in an electrolyte solution so as to dissolve the oxide scale; and subjecting titanium material to acid pickling so as to remove the remaining oxide scale and any oxide film generated in the process of the electrolysis. (2) A method of descaling titanium material comprising the steps of: immersing titanium material having oxide scale on a surface thereof in a fused alkaline salt bath so as to dissolve a portion of the scale; subjecting the titanium material to anodic electrolysis or alternate electrolysis in an electrolyte solution so as to dissolve the oxide scale; and subjecting the titanium material to acid pickling so as to remove remaining oxide scale or oxide film generated in the process of the electrolysis.

In the present invention, titanium refers to commercial pure titanium or a titanium alloy, and titanium material refers to titanium or a titanium alloy in the forms of plates, tubes, wires, bars, and the like. The form of titanium material is not particularly limited.

The present inventors performed a variety of experiments in order to achieve the above-described objects, and as a result have found the following:

a) In the case of a thin scale layer having a thickness of less than 10 nm, sufficient descaling can be performed merely through immersion in an acid pickling solution such as a nitric-hydrofluoric acid pickling solution. However, this method requires a long time for removing a scale layer having a thickness of 10 nm or more. In this case, surface roughness is likely to become high, and surface brightness is likely to become uneven.

b) In the case of a relatively thin scale having a thickness of about 10–350 nm, complete descaling can be performed by subjecting the titanium material to anodic electrolysis or alternate electrolysis performed in an electrolyte solution, instead of subjecting the titanium material to the conventional treatment using a fused alkaline salt bath, so as to dissolve the scale, and subjecting the titanium material to acid pickling by use of a nitric-hydrofluoric acid pickling solution. In this case, an excellent surface finish obtained.

c) In the case of a titanium material which has a thick scale layer having a thickness of about 350 nm or more, method b above requires a long time for acid pickling, resulting in lowered efficiency of acid pickling. Therefore, prior to the electrolysis treatment, the thickness of the scale must be reduced to not greater than about 300 nm and not less than about 30 nm in a fused alkaline salt bath so as not to generate sparks.

d) Titanium material which has been subjected to an electrolysis treatment can be satisfactorily acid-pickled by use of any acid pickling solution other than a conventionally used nitric-hydrofluoric acid pickling solution. An example of such an acid pickling solution is a mixed acid solution composed of sulfuric acid and/or hydrochloric acid with addition of hydrofluoric acid and hydrogen peroxide.

The method of the present invention is characterized by dissolving scale of titanium material by electrolysis so as to reduce the thickness of the scale. Therefore, according to the present invention, the thickness of scale can be remarkably reduced before acid pickling, particularly as compared with the thickness of scale before acid pickling in a conventional descaling method in which a titanium strip is successively subjected to a fused alkali salt bath treatment and acid pickling. As a result, the concentration of acid used for acid pickling can be considerably lowered, leading to greatly reduced acid consumption. Also, dissolution of titanium base metal from which scale has been removed by acid pickling is considerably suppressed, so that the loss of base metal by acid pickling is reduced, and the amount of sludge produced in a waste acid treatment is greatly reduced. Therefore, the present invention is advantageous in terms of preservation of the environment. Further, since the dissolution rate of titanium base metal is reduced by use of an acid pickling solution, having a concentration lower than that of a conventional acid pickling solution, even if the titanium material has a portion where its base metal is exposed due to early local dissolution of scale, local corrosion of the base metal is suppressed to a minimum. As a result, titanium material having a low surface roughness and excellent surface brightness can be easily manufactured.

BRIEF DESCRIPTION OF THE DRAWINGS

FIG. 3 is a graph for explaining the method of determining average surface roughness Ra as prescribed in JIS B0601.

DETAILED DESCRIPTION OF THE INVENTION

Figure 1:
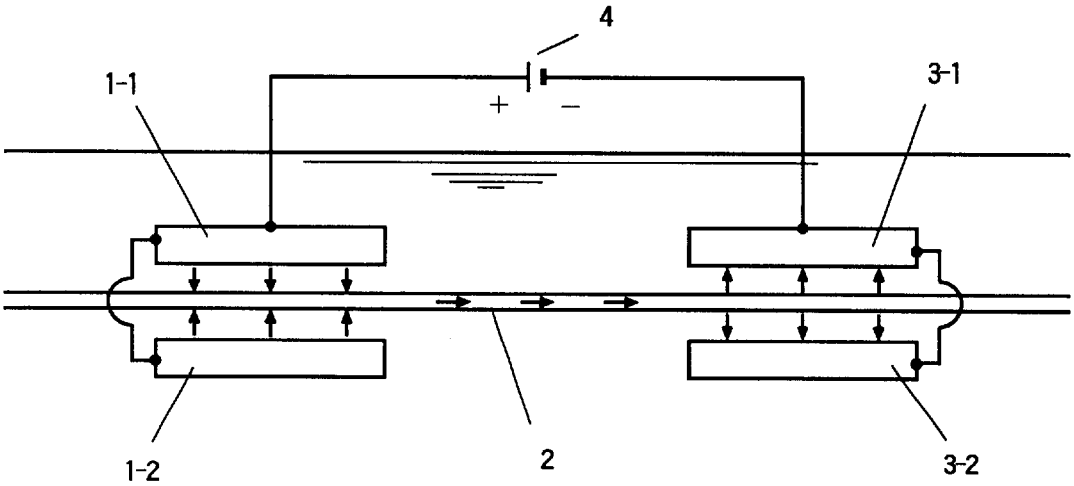
FIG. 1 is a schematic view for explaining a successive electrolysis treatment method employing alternate electrolysis.

Titanium material to be treated by the method of descaling according to the present invention is a titanium material which has on its surface oxide scale, having a thickness of 10–600 nm and containing oxides as the main components. The titanium material may have a variety of forms such as plate, tube, bar, or wire. Representative examples of the oxide scale include oxide scale generated in the process of annealing in a weakly oxidizing atmosphere or a hydrocarbon-gas-combusting atmosphere after cold processing, such as cold rolling or cold drawing. However, the method of the present invention can be applied to any oxide scale having a thickness of about 10–600 nm, regardless of whether or not the oxide scale is generated in the process of annealing.

If the scale has a thickness of less than 10 nm, the scale can be sufficiently removed merely through acid pickling by use of a nitric-hydrofluoric acid pickling solution. However, if the titanium material which has scale having a thickness of greater than 10 nm, is descaled merely through acid pickling by use of a nitric-hydrofluoric acid pickling solution, the following problems are likely to arise: acid pickling requires a long time; surface roughness becomes high after descaling; and surface brightness becomes uneven because of nonuniform acid pickling. These problems are caused by the following mechanism: since the dissolution rate of the titanium base metal is considerably higher than that of the oxide scale in the titanium base metal, the depth of corrosion caused by acid pickling becomes greater at regions where the scale is dissolved relatively early as compared with regions where the scale is dissolved relatively late.

A titanium material which has a thin scale, having a thickness of about 10–350 nm, does not always require a fused alkaline salt bath treatment. Such a titanium material is efficiently descaled by anodic electrolysis or alternate electrolysis, performed in an aqueous electrolyte solution, and subsequent immersion of the titanium material in an acid pickling solution, such as a nitric-hydrofluoric solution, which can dissolve the titanium base metal.

Also, a titanium material which has a thick scale, having a thickness of about 350 nm or more, can be efficiently descaled in the following manner: the titanium material is subjected to the fused alkaline salt bath method so as to dissolve most of the scale; and the remaining scale is removed by electrolysis performed in an electrolyte solution.

When the titanium material is acid-pickled thereafter, a remarkably smooth and glossy surface can be obtained. In order to prevent generation of sparks in the fused alkaline salt bath and to efficiently perform descaling through the electrolysis treatment in the electrolyte solution and acid pickling, the thickness of the scale is preferably reduced to 30–300 nm, more preferably 50–200 nm, during immersion in the fused alkaline salt bath.

As described above, titanium material suitable for application of the method of descaling by electrolysis performed in an electrolyte solution without the use of a fused alkali salt bath treatment, is titanium material which has on its surface a relatively thin scale generated in the course of annealing in a weakly oxidizing atmosphere.

In the present invention, a weakly oxidizing atmosphere refers to an atmosphere having low oxidizing power as compared with an atmosphere containing a strongly oxidizing oxygen in an amount of about 21% by volume ("%" indicative of gas contained in an atmosphere hereinafter refers to "% by volume"), such as ordinary air, or as compared with an atmosphere containing strongly oxidizing water vapor and excess oxygen in an amount from a few % to about 10~15%, such as a hydrocarbon-gas-combusting atmosphere in an annealing furnace of a successive annealing-pickling line for stainless steel plates.

Also, the weakly oxidizing atmosphere has strong oxidizing power as compared with an atmosphere having strong reducing power, such as an atmosphere containing 75% hydrogen and 25% nitrogen which is generally used in bright annealing for stainless steel.

Specifically, the weakly oxidizing atmosphere is an atmosphere which predominantly contains an inert gas having neither oxidizing power nor reducing power, such as nitrogen or argon; and also contains, singly or in a combination, oxygen, water vapor, and carbon dioxide, each having oxidizing power, in an amount of about 0.001–2%, or hydrogen and carbon monoxide, each having reducing power, in an amount of about 1–20%. Further, the weakly oxidizing atmosphere is equivalent to a low vacuum atmosphere (an atmosphere under relatively low vacuum) under a pressure of about 1 to a few hundreds Pa (Pascal).

When titanium material is annealed for a few tens of seconds to a few minutes, the surface of the titanium material assumes an interference color such as ocher yellow, violet, or blue. The tone of the interference color depends on the thickness of oxide scale formed on the surface of the titanium material. The tone of the interference color becomes most vivid when the thickness is about 20~40 to 200 nm, and becomes a dull grayish tone as the thickness increases further. Therefore, the method performed without use of a fused alkaline salt bath treatment, according to the present invention, is most suitable for descaling the titanium and the titanium alloy, which have a scale assuming an interference color, or a scale having a thickness slightly greater than that of the scale assuming the interference color.

Cold-rolled titanium strips can be successively annealed by use of annealing equipment such as that used in bright annealing (BA) of stainless steel strips. When titanium is annealed in an atmosphere having a high hydrogen concentration of about 75%, as in the case of bright annealing of stainless steel, brittle hydride is produced, which may lead to a rupture of the strip. In this case, the atmosphere of an annealing furnace is advantageously composed of nitrogen gas alone, or nitrogen gas and hydrogen in an amount of 20% or less. Since hydrogen is more expensive than nitrogen, reduction of hydrogen concentration in the atmosphere contributes to reduction in treatment cost. However, in practice, an annealing furnace inevitably involves emission of water vapor or oxygen through the walls of the annealing furnace, or oxygen or moisture carried by the titanium strips into the annealing furnace. Consequently, these oxidizing substances accelerate oxidation of the surfaces of the titanium strips. Addition of hydrogen in the atmosphere is an effective measure for suppressing such oxidation. Alternatively, carbon monoxide, which has a reducing power similar to that of hydrogen, may be added to the atmosphere so as to suppress the oxidation of the surface of the titanium strips. However, since carbon monoxide is highly toxic, the concentration of carbon monoxide is preferably 20% or less in order to minimize the damage in case of leakage.

Also, cold-rolled titanium strips can be annealed in the form of a coil by use of a batch annealing furnace. As described above, the atmosphere in such a batch annealing furnace may be a low vacuum atmosphere having a pressure of about 1 to several hundreds Pa, or an atmosphere containing an inert gas such as nitrogen or argon. In the case where the inert gas contains an oxidizing gas such as oxygen, water vapor, or carbon dioxide, hydrogen or carbon monoxide is preferably added to the atmosphere in order to regulate the thickness of scale to about 10–200 nm. In the case where the atmosphere contains nitrogen, nitrides may be produced in the scale. Even in such a case, if the nitrogen concentration is 20% or less, descaling can be performed by the method of the present invention.

Further, titanium material having a relatively thin scale suitable for application of the method including electrolysis performed in an electrolyte solution and acid pickling without a fused alkaline salt bath treatment can be produced in the process of annealing by use of a combustion-heating furnace using hydrocarbon as fuel, rather than in the process of annealing in a weakly oxidizing atmosphere, so long as the annealing satisfies the following conditions:

The annealing temperature is 750° C. or less, and the annealing time is 50–150 seconds, depending on the thickness of a titanium material. If the annealing temperature is above 750° C. and the annealing time is over 150 seconds, the method including electrolytic descaling and acid pickling alone takes a long time for descaling. Therefore, in this case, titanium material is preferably subjected to a fused alkaline salt bath treatment before the electrolysis treatment.

Recommendable examples of the fused alkaline salt bath include a mixture of an alkali metal hydroxide or an alkaline-earth metal hydroxide and a salt, such as a mixture containing sodium nitrate in an amount of 5–20% by mass with the remainder comprising sodium hydroxide. Appropriately, the bath temperature is about 450–500° C., and time for immersion is about 5–20 seconds. However, as mentioned above, it is important to perform the fused alkaline salt bath treatment under certain conditions such that the scale remains in such an amount as to completely prevent generation of sparks between an immersion roll and a titanium strip.

Next, an aqueous electrolyte solution will be described.

Examples of substances usable as electrolytes include acids such as sulfuric acid, nitric acid, and hydrochloric acid, and mixtures thereof; salts such as sulfates, nitrates, and hydrochlorides, and mixtures thereof; mixtures of such acids and such salts; and alkalis such as hydroxides of alkali metals and alkaline-earth metals. An oxidizing agent (a peroxide such as a permanganate) may be added to the electrolyte.

Specifically, the following aqueous solutions can be used.

1) An aqueous solution containing nitric acid alone.

2) A mixed acid solution containing nitric acid essentially, and one or more components selected from among nitrates, nitrites, sulfates, nitrous acid, sulfuric acid, and hydrochloric acid.

3) A mixed acid solution containing one or more components selected from among nitrates, nitrites, chromates, dichromates, permanganates, and trivalent iron ions; and either or both of sulfuric acid and hydrochloric acid.

4) An aqueous solution containing one or more components selected from among nitrates, nitrites, sulfates, chlorides, chromates, dichromates, and permanganates.

5) A mixed acid solution containing one or more hydroxides of alkali metal or an alkaline-earth metal; and one or more components selected from among nitrates, nitrites, chromates, dichromates, and permanganates.

Preferably, an acid having oxidizing power is used in order to dissolve and ionize the scale of titanium into hexavalent ions. For this reason, an acid containing nitric acid or nitrate is advantageously used.

When an aqueous solution containing nitric acid alone is used, no strict limitation is placed on the concentration of nitric acid. However, if the nitric acid concentration is excessively low, electric resistance becomes high, resulting in a great loss of electric power, whereas if the nitric acid concentration is excessively high, a large amount of toxic gas is produced. Therefore, the concentration is appropriately 3–30% by mass ("%" indicative of the concentration of an electrolyte solution refers to "% by mass").

Use of sulfuric acid contributes to reduction of treatment cost, since it is relatively inexpensive. However, if sulfuric acid is used singly, titanium absorbs hydrogen in the process of cathodic electrolysis. Therefore, sulfuric acid is preferably used in the form of a mixture with nitric acid. In this case, the mole ratio of sulfuric acid to nitric acid is appropriately 2:1 or less.

Hydrochloric acid exhibits an effect of accelerating descaling by electrolysis. However, since hydrochloric acid itself has a considerably great ability to dissolve titanium base metal, if it is used singly, corrosion becomes deep at regions where descaling is provided relatively early, resulting in highly rough surfaces. Also, as in the case of sulfuric acid, there is a great risk that titanium absorbs hydrogen and becomes brittle during cathodic electrolysis. Therefore, hydrochloric acid is preferably used in the form of a mixture with nitric acid. In this case, the mole ratio of hydrochloric acid to nitric acid is appropriately 2:1 or less.

The temperature of these acids is not particularly limited. However, if the temperature is low, the dissolution rate of scale is low; whereas if the temperature is excessively high, the acid produces a large amount of vapor. Therefore, the temperature is appropriately 20–60° C.

As the salt, a salt having high solubility and a high degree of electrolytic dissociation is preferably used in order to reduce electric power consumption during electrolysis, since such a salt reduced the electric resistance of the aqueous solution. For this reason, among salts of representative strong acids such as sulfuric acid, nitric acid, and hydrochloric acid, and strong alkalis, a high-solubility salt is recommended. Specifically, sodium sulfate is advantageous in terms of cost, chemical stability, and like factors. Also, sodium nitrate and sodium chloride are suitably selected.

The concentrations and temperatures of these salts are not particularly limited. However, if the concentration is excessively low, electric resistance becomes high, resulting in high electric power consumption during electrolysis. Therefore, the concentration is desirably within the range of 10% to a saturated concentration. Also, as the temperature increases, solubility increases and electric resistance decreases, resulting in a short service life of a vessel. Therefore, the temperature is preferably about 50–90° C.

The salt and the acid may be used in combination. If sulfuric acid or hydrochloric acid is used as the acid, there is a fear that titanium material absorbs hydrogen in the process of cathodic electrolysis. Therefore, the concentration of the acid is preferably 10% or less, and the acid is preferably used in the form of a mixture with nitrate or nitric acid, which has oxidizing power.

Preferably, there is used an alkali having a high degree of dissociation in an aqueous solution; specifically, a hydroxide of alkali metal such as sodium hydroxide. Descaling performance can be improved if an oxidizing agent is added to the alkali solution. Preferred examples of the oxidizing agent include nitrates such as sodium nitrate, and permanganates such as potassium permanganate. In addition, hydrogen peroxide may be used. The concentrations and temperatures of these alkali solutions are not particularly limited. However, if the concentration is low, electric resistance becomes high, resulting in high electric power consumption during electrolysis. Therefore, the concentration is desirably within the range of 10% to a saturation concentration. Also, as the temperature increases, solubility increases and electric resistance decreases, resulting in a short service life of a vessel. Therefore, the temperature is preferably about 50–90° C.

FIG. 1 schematically shows a state of electrolysis caused by an indirect current feeding method according to the descaling method of the present invention. In FIG. 1, positive electrodes and negative electrodes are arranged along the advancement direction of titanium material in a electrolysis vessel containing electrolyte solution. As the positive electrodes, an upper positive electrode 1-1 and a lower positive electrode 1-2 are disposed such that they face each other. Titanium material 2 is caused to pass therebetween. Likewise, an upper negative electrode 3-1 and a lower negative electrode 3-2 are disposed such that they face each other. Current fed from the positive electrodes connected to a DC power source 4 flows through the titanium strip toward the negative electrodes. Therefore, cathodic electrolysis is induced on the surface of the strip in the vicinity of the positive electrodes, and anodic electrolysis is induced on the surface of the strip in the vicinity of the negative electrodes.

In an electrolysis treatment performed in an electrolyte solution, anodic electrolysis or alternate electrolysis exhibits a strong descaling effect, and cathodic electrolysis exhibits a relatively weak descaling effect.

The descaling mechanism of an electrolysis treatment of titanium material performed in an electrolyte solution is not clearly identified at present. However, the mechanism is presumed to be as follows: the oxide of titanium contained in scale is oxidized into hexavalent ions ($TiO_2^{2+}$) and dissolved in the solution during the process of anodic electrolysis, and $TiO_2$ contained in the scale is reduced into trivalent ions ($Ti^{3+}$) and dissolved in the solution during the process of cathodic electrolysis. Investigation conducted by the present inventors has revealed that the dissolution rate of the former ($TiO_2^{2+}$) is higher than that of the latter ($Ti^{3+}$).

If a titanium strip is subjected to only anodic electrolysis, electric power must be supplied by use of a current-carrying roll such as that used in successive electroplating. In this case, if scale is present on the surfaces of the strip, anodic electrolysis cannot be performed, since the electric resistance of the scale is high. By contrast, if a titanium strip is subjected to electrolysis by the indirect current feeding method, the strip is naturally subjected to alternate electrolysis. Therefore, alternate electrolysis is recommended.

It should be noted that if a titanium strip is successively descaled by the indirect current feeding method, the efficiency of descaling may vary considerably according to the arrangement of electrodes. The strip is subjected to anodic electrolysis and cathodic electrolysis by the indirect current feeding method as mentioned above. However, if a limitation is imposed on total time for anodic electrolysis, time for one passage through the anodic electrolysis is preferably extended as long as possible. For this purpose, there may be employed the arrangement of electrodes shown in FIG. 2(*a*) in which the surfaces of a titanium strip facing negative electrodes 3-1 are subjected to anodic electrolysis for a long time. This arrangement provides efficiency of descaling several times which is achieved in the case of the arrangement shown in FIG. 2(*b*) in which positive electrodes 1-1 and negative electrodes 3-1 are alternately disposed. The reason why the arrangement of FIG. 2(*b*) has lower descaling efficiency is presumably because dissolution of scale by anodic electrolysis becomes less likely to occur if anodic electrolysis is interrupted by the cathodic electrolysis.

Figure 2A:
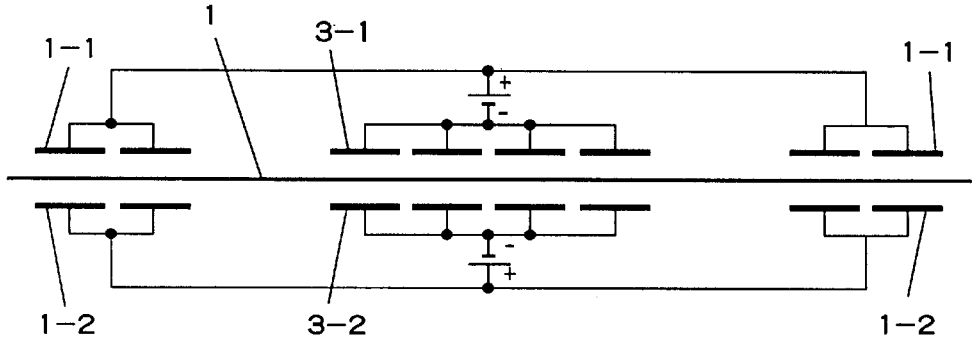
FIGS. 2(*a*)–(*c*) are diagrams showing examples of the arrangement of electrodes in the alternate electrolysis.
Figure 2B:
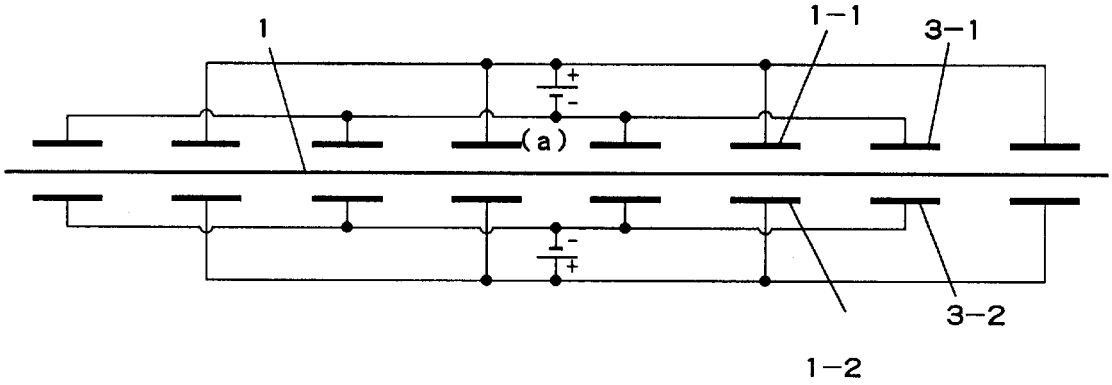
Figure 2B:
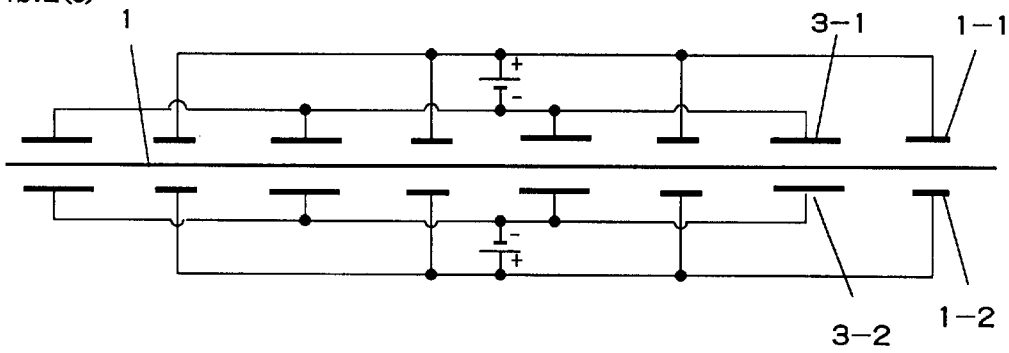

In the arrangement of electrodes shown in FIG. 2(*a*), sets of opposite negative electrodes or sets of opposite positive electrodes are disposed close to each other so that the length of a vessel can be reduced. Also, the length of a vessel, along with cost for space and equipment, can be reduced by employing the arrangement shown in FIG. 2(*c*) in which the length of each positive electrode 1-1 is made shorter than that of each negative electrode 3-1 in the line direction, or by reducing the number of positive electrodes to less than the number of cathodes, since dissolution of scale is more likely to occur in the anodic electrolysis than in the cathodic electrolysis.

By contrast, in the case of titanium in the form of a sheet, bar, or wire, anodic electrolysis or alternate electrolysis can be carried out by use of stainless steel or platinum as counter electrodes and by connecting these electrodes to a DC power source or an AC power source by use of lead wires.

Current density during electrolysis greatly influences a descaling effect. As the current density increases, the rate of descaling increases. Generally, if the current density is less than 0.5 $A/dm^2$, substantially no descaling effect is provided. Therefore, the current density is preferably 10 $A/dm^2$ or more. If the current density is in excess of 50 $A/dm^2$ a large amount of gas such as oxygen, hydrogen, or nitrogen oxide is produced, resulting in lowered efficiency. Also, as the time for electrolysis increases, descaling is accelerated. However, if unnecessarily extended, electrolysis leads to wasteful consumption of electric power; therefore, the net time for anodic electrolysis is appropriately 5–200 seconds. Further, if an electrolyte solution is sulfuric acid or hydrochloric acid which contains no oxidizing substances, there is a fear that the titanium material may absorb hydrogen and become brittle during cathodic electrolysis in alternate electrolysis. Such an electrolyte solution should not be used, since base metal may suffer nonuniform corrosion after its scale is completely dissolved.

Also, even in the case where the acid contains an oxidizing substance such as nitric acid, if it also contains fluorine like hydrofluoric acid, the acid is not an appropriate electrolyte solution. The reason is that the titanium base metal and scale (titanium dioxide) are highly reactive to a compound containing fluorine such as hydrofluoric acid, and such a compound corrodes the scale in a nonuniform manner, regardless of whether or not electrolysis is performed, and also further corrodes the base metal of the titanium at a faster rate after the corrosion reaches the base metal, and this results in surfaces having many projections and depressions.

Titanium dioxide, which is a main component of the scale, can be oxidized into hexavalent ions, pertitanic acid ions ($TiO_2^{2+}$) by anodic electrolysis or alternate electrolysis, and the ions can be dissolved. In order to promote this reaction, the electric potential is preferably as high as 2–20 V (vs. SCE) during anodic electrolysis.

Also, in the case of titanium material having a thick scale and an excessive thickness, the titanium material may be subjected to a shot blast treatment before an electrolysis treatment.

Next will be described acid pickling of titanium material after descaling by electrolysis, as well as an acid pickling solution used in the acid pickling.

The main purpose of acid pickling is to dissolve and remove oxide scale which could remain after an electrolysis treatment, so as to expose titanium base metal. If an electrolysis treatment is performed to an excessive degree, oxide film is sometimes formed on the titanium material in the course of anodic electrolysis or alternate electrolysis (the oxide film is hereinafter called "anodic oxide film"). Another purpose of acid pickling is to dissolve and remove such anodic oxide film. The main component of the oxide scale of a titanium material is titanium dioxide ($TiO_2$) of a rutile type, which is relatively difficult to dissolve in acid. On the other hand, the main component of the anodic oxide film is titanium dioxide ($TiO_2$) of an anatase type, which is easily dissolved in acid. In any case, in order to efficiently dissolve the oxide scale and the anodic oxide film, it is preferable to use an acid pickling solution which mainly contains a fluorine-containing component such as hydrofluoric acid or hydrosilicofluoric acid ($H_2SiF_6$). A specifically recommended nitric-hydrofluoric acid pickling solution is one which contains nitric acid and hydrogen fluoride at appropriate concentrations. The concentration of hydrofluoric acid is about 0.5–3% by mass. As the concentration increases, the dissolution rates of titanium base metal and scale increase, resulting in high descaling performance. However, in this case, the surface of the titanium material is likely to be rough after acid pickling. The concentration of nitric acid is about 5–20% by mass. As the concentration increases, the surface of the titanium material becomes smooth and glossy after acid pickling; however, descaling performance tends to deteriorate.

Acid pickling by use of a solution containing only hydrofluoric acid without addition of nitric acid is also possible. However, there is a risk that the surfaces of the titanium material becoms rough after acid pickling and if the titanium material absorbs hydrogen it may become brittle. In order to prevent the absorption of hydrogen in acid pickling of titanium by use of a nitric-hydrofluoric acid pickling solution, the ratio of nitric acid to hydrofluoric acid is preferably 10:1 or more. The temperature of a nitric-hydrofluoric acid pickling solution is appropriately 20–60° C. As the temperature increases, the rate of acid pickling increases.

Since a nitric-hydrofluoric acid pickling solution contains nitric acid, it produces toxic nitrogen dioxide gas and nitrogen oxide gas in the process of acid pickling. Also, a large amount of toxic nitrate ions is contained in a waste solution obtained through a waste acid treatment employing alkali neutralization of a nitric-hydrofluoric acid pickling solution, which has poor ability to dissolve titanium base metal. Therefore, the waste solution cannot be discharged as waste water without further treatment.

In view of the foregoing, the present inventors studied an acid pickling solution containing no nitric acid, and found that descaling of titanium material can be performed by means of a mixed acid solution containing sulfuric acid and/or hydrochloric acid with addition of hydrofluoric acid and hydrogen peroxide.

In a solution containing either sulfuric acid or hydrochloric acid, the proper concentration of sulfuric acid is about 5–20% by mass (about 1.1–4.7 N), and the proper concentration of hydrochloric acid is about 2–15% by mass (about 1.1–4.3 N). In a solution containing both sulfuric acid and hydrochloric acid, the total concentration of the acids is regulated to 1.1–4.5 N. Appropriately, the concentration of hydrofluoric acid is about 0.5–5% by mass, and the concentration of hydrogen peroxide is about 2–10% by mass. The temperature of the solution is appropriately 20–45° C. Descaling of titanium material can be also be performed by means of an acid such as sulfuric acid having a concentration of 10–50% by mass and a temperature of 50–90° C., or hydrochloric acid having a concentration of 5–30% by mass and a temperature of 20–60° C., in addition to the above-described acids containing fluoride. However, such an acid has a rate of acid pickling lower than that of the acid pickling solution containing fluoride.

EXAMPLES

Example 1

Test pieces (100 mm wide×150 mm long) were cut from each of cold-rolled strips of commercial pure titanium and titanium alloy having the chemical compositions as shown in Table 1. The test pieces were annealed under the conditions as shown in Table 2 by use of an electric furnace whose atmosphere was controllable. As shown in Table 2, two kinds of annealing atmospheres were employed; i.e., 90% $N_2$+10% $H_2$, and 70% $N_2$+1% $CO_2$+14% CO+15% $H_2$.

TABLE 1

(% by mass)

| Symbol | O | Fe | C | N | H | Ti | Others | Plate thickness (mm) | Remarks |
|---|---|---|---|---|---|---|---|---|---|
| A | 0.08 | 0.10 | 0.05 | 0.03 | 0.007 | Remainder | | 1.0 | Pure titanium |
| B | 0.16 | 0.15 | 0.05 | 0.03 | 0.008 | Remainder | | 0.8 | Pure titanium |
| C | 0.15 | 0.31 | 0.06 | 0.03 | 0.008 | Remainder | Al: 6.0, V: 4.1 | 1.0 | Titanium alloy |
| D | 0.15 | 0.38 | 0.05 | 0.03 | 0.007 | Remainder | Al: 4.9, Sn: 2.5 | 1.2 | Titanium alloy |
| E | 0.12 | 0.14 | 0.06 | 0.02 | 0.007 | Remainder | Pd: 0.15 | 1.0 | Titanium alloy |

These annealing atmospheres were regulated by a method in which water vapor was added, as needed and by use of a humidifier, to high-purity nitrogen, hydrogen, carbon dioxide, carbon monoxide, and oxygen.

The values under "thickness of scale" shown in Table 2 were obtained in the following manner: a portion of an annealed test piece was dissolved by the bromine-methanol method so as to obtain the mass of film peeled from the surface of the test piece, to thereby calculate the thickness of scale (the values were calculated on the assumption that the density of the film is 3.9 g/cm$^3$). In order to confirm the accuracy of the measured thickness of scale, another portion of the annealed test piece was buried in resin, the cross section thereof was polished and subjected to etching, and the thickness of scale was measured under a scanning electron microscope. As a result, the thus-measured thickness was found to be close to the thickness measured through the above-described bromine-methanol method for peeling.

TABLE 2

| Symbol | Test material (symbol) | Annealing temperature (° C.) | Heating time (min.) | Annealing atmosphere (% by volume) | Thickness of scale (nm) |
|---|---|---|---|---|---|
| I | A | 700 | 2.5 | 90% $N_2$ + 10% $H_2$ | 35 |
| II | | | | 70% $N_2$ + 1% $CO_2$ + 14% CO + 15% $H_2$ | 132 |
| III | B | 730 | 2.5 | 90% $N_2$ + 10% $H_2$ | 56 |
| IV | | | | 70% $N_2$ + 1% $CO_2$ + 14% CO +15% $H_2$ | 156 |
| V | D | 780 | 3.0 | 90% $N_2$ + 10% $H_2$ | 105 |
| VI | | | | 70% $N_2$ + 1% $CO_2$ + 14% CO + 15% $H_2$ | 270 |

Next, the test pieces were subjected to electrolysis treatments under the conditions shown in Table 4, by use of electrolyte solutions having the compositions and temperatures shown in Table 3. After the electrolysis treatments, the test pieces were washed with water, subjected to acid pickling by use of the following two types of acid pickling solutions, washed with water again, and dried.

TABLE 3

| Symbol | Composition (% by mass) | (Remainder: water) Temperature (° C.) |
|---|---|---|
| a | 12% $HNO_3$ | 50 |
| b | 15% $HNO_3$-5% $H_2SO_4$-1% HCl | 50 |
| c | 20% $Na_2SO_4$ | 70 |
| d | 15% $Na_2SO_4$-5% $NaNO_3$ | 80 |
| e | 40% NaOH-5% $NaNO_3$ | 70 |
| f | 40% NaOH-3% $KMnO_4$ | 70 |

TABLE 4

| | Cathodic electrolysis | | Anodic electrolysis | | Number | |
|---|---|---|---|---|---|---|
| Symbol | Current density (A/dm$^2$) | Time (s) | Current density (A/dm$^2$) | Time (s) | of repetitions | Remarks |
| 1 | — | — | 2 | 30 | 1 | Only |
| 2 | — | — | 5 | 30 | 1 | anodic |
| 3 | — | — | 10 | 30 | 1 | electrolysis |
| 4 | — | — | 5 | 20 | 1 | |
| 5 | — | — | 5 | 60 | 1 | |
| 6 | — | — | 5 | 120 | 1 | |
| 7 | 2 | 10 | 2 | 10 | 3 | Alternate |
| 8 | 5 | 10 | 5 | 10 | 3 | electrolysis |
| 9 | 10 | 10 | 10 | 10 | 3 | (sequentially from |
| 10 | 5 | 10 | 5 | 10 | 2 | cathodic electrolysis |
| 11 | 5 | 10 | 5 | 10 | 6 | to anodic |
| 12 | 5 | 10 | 5 | 10 | 12 | electrolysis) |
| 13 | 2 | 30 | — | — | 1 | Only cathodic |

TABLE 4-continued

| | Cathodic electrolysis | | Anodic electrolysis | | Number | |
|---|---|---|---|---|---|---|
| Symbol | Current density (A/dm$^2$) | Time (s) | Current density (A/dm$^2$) | Time (s) | of repetitions | Remarks |
| 14 | 5 | 30 | — | — | 1 | electrolysis |
| 15 | 10 | 30 | — | — | 1 | |
| 16 | 5 | 20 | — | — | 1 | |
| 17 | 5 | 60 | — | — | 1 | |
| 18 | 5 | 120 | — | — | 1 | |

(1) Nitric-hydrofluoric acid pickling solution (abbreviated as "acid pickling solution M"):

10 mass %$HNO_3$–1 mass % HF

Temperature of solution: 50° C., Time of immersion: 60 seconds (2) Mixed acid solution of sulfuric acid, hydrofluoric acid, and hydrogen peroxide (abbreviated as "acid pickling solution N"):

10 mass % $H_2SO_4$+2 mass % HF+5 mass % $H_2O_2$

Temperature of solution: 30° C., Time of immersion: 60 seconds

For comparison, without the electrolysis treatment, a group of the test pieces was descaled by use of the acid pickling solution M alone or the acid pickling solution N alone. Next, the surface of each test piece was observed with the naked eye and under an optical microscope, to thereby evaluate the degree of remaining scale. In contrast, the completely descaled test pieces were measured for average surface roughness in accordance with JIS B0601. The results are shown in Tables 5 through 7.

Remaining scale was evaluated according to the following five grades.

1: There remains a large amount of scale which can be observed with the naked eye 2: There remains a considerable amount of scale which can be observed with the naked eye 3: There remains a considerable amount of scale which can be observed under an optical microscope (a slight amount of scale can be observed with the naked eye)

4: There remains a slight amount of scale which can be observed under an optical microscope 5: No remaining scale can be observed under an optical microscope As shown in Table 3, Ra is a value measured in micrometers ($\mu$m) and calculated through the following equation, when a portion of a roughness curve (y=f(x)) having a predetermined unit length in the direction of an average line is taken out, the X axis is provided in the direction of the average line of the portion, the Y axis is provided in the direction of the longitudinal magnification of the portion.

$$R_a = \frac{1}{l}\int_0^l |f(x)|\,dx$$

where, l: standard length

TABLE 5

| Test No. | Annealing conditions (symbol) | First electrolysis treatment: Electrolyte solution | First electrolysis treatment: Electrolysis conditions | Second electrolysis treatment: Electrolyte solution | Second electrolysis treatment: Electrolysis conditions | Descaling: Acid pickling solution M | Descaling: Acid pickling solution N | Surface roughness*: Acid pickling solution M | Surface roughness*: Acid pickling solution N | Remarks |
|---|---|---|---|---|---|---|---|---|---|---|
| 1 | I | a | 1 | — | — | 5 | 5 | 0.11 | 0.15 | Example of |
| 2 | I | a | 2 | — | — | 5 | 5 | 0.09 | 0.11 | the present |
| 3 | I | a | 3 | — | — | 5 | 5 | 0.09 | 0.11 | invention |
| 4 | I | a | 4 | — | — | 5 | 5 | 0.09 | 0.11 | |
| 5 | I | a | 5 | — | — | 5 | 5 | 0.10 | 0.11 | |
| 6 | I | a | 6 | — | — | 5 | 5 | 0.10 | 0.12 | |
| 7 | I | a | 7 | — | — | 5 | 5 | 0.09 | 0.11 | |
| 8 | I | a | 8 | — | — | 5 | 5 | 0.11 | 0.12 | |
| 9 | I | a | 9 | — | — | 5 | 5 | 0.11 | 0.13 | |
| 10 | I | a | 10 | — | — | 5 | 5 | 0.11 | 0.12 | |
| 11 | I | a | 11 | — | — | 5 | 5 | 0.08 | 0.09 | |
| 12 | I | a | 12 | — | — | 5 | 5 | 0.09 | 0.11 | |
| 13 | I | a | 13 | — | — | 3 | 3 | 0.11 | 0.16 | Comp. Ex. |
| 14 | I | a | 14 | — | — | 3 | 3 | 0.11 | 0.13 | |
| 15 | I | a | 15 | — | — | 3 | 3 | 0.10 | 0.12 | |
| 16 | I | a | 16 | — | — | 3 | 3 | 0.12 | 0.12 | |
| 17 | I | a | 17 | — | — | 3 | 3 | 0.10 | 0.12 | |
| 18 | I | a | 18 | — | — | 3 | 3 | 0.10 | 0.10 | |
| 19 | I | c | 5 | a | 5 | 5 | 5 | 0.09 | 0.11 | Example of |
| 20 | I | c | 5 | a | 11 | 5 | 5 | 0.08 | 0.11 | the present |
| 21 | I | c | 5 | a | 17 | 5 | 5 | 0.08 | 0.12 | invention |
| 22 | I | c | 11 | a | 5 | 5 | 5 | 0.08 | 0.11 | |
| 23 | I | c | 11 | a | 11 | 5 | 5 | 0.08 | 0.10 | |
| 24 | I | c | 11 | a | 17 | 5 | 5 | 0.08 | 0.12 | |
| 25 | I | — | — | — | — | 1 | 1 | — | — | Comp. Ex. |

Comp. Ex.: Comparative Example
*Ra (μm)

TABLE 6

| Test No. | Annealing conditions (symbol) | First electrolysis treatment: Electrolyte solution | First electrolysis treatment: Electrolysis conditions | Second electrolysis treatment: Electrolyte solution | Second electrolysis treatment: Electrolysis conditions | Descaling: Acid pickling solution M | Descaling: Acid pickling solution N | Surface roughness*: Acid pickling solution M | Surface roughness*: Acid pickling solution N | Remarks |
|---|---|---|---|---|---|---|---|---|---|---|
| 26 | II | c | 5 | a | 5 | 5 | 5 | 0.12 | 0.16 | Ex. |
| 27 | II | c | 8 | a | 8 | 5 | 5 | 0.12 | 0.16 | |
| 28 | II | c | 11 | a | 11 | 5 | 5 | 0.12 | 0.15 | |
| 29 | II | c | 17 | a | 17 | 3 | 3 | 0.12 | 0.18 | Comp. Ex. |
| 30 | II | e | 5 | d | 5 | 5 | 5 | 0.11 | 0.15 | |
| 31 | II | e | 8 | d | 8 | 5 | 5 | 0.09 | 0.13 | |
| 32 | II | e | 11 | d | 11 | 5 | 5 | 0.12 | 0.16 | |
| 33 | II | e | 17 | d | 17 | 3 | 3 | 0.12 | 0.15 | Comp. Ex. |
| 34 | II | e | 5 | c | 5 | 5 | 5 | 0.09 | 0.12 | Ex. |
| 35 | II | e | 8 | c | 8 | 5 | 5 | 0.09 | 0.12 | |
| 36 | II | e | 11 | c | 11 | 5 | 5 | 0.09 | 0.12 | |
| 37 | II | e | 17 | c | 17 | 3 | 3 | 0.12 | 0.16 | Comp. Ex. |
| 38 | II | f | 5 | c | 5 | 5 | 5 | 0.09 | 0.11 | Ex. |
| 39 | II | f | 8 | c | 8 | 5 | 5 | 0.10 | 0.12 | |
| 40 | II | f | 11 | c | 11 | 5 | 5 | 0.10 | 0.12 | |
| 41 | II | f | 17 | c | 17 | 3 | 3 | 0.11 | 0.17 | Comp. Ex. |
| 42 | II | c | 5 | e | 5 | 5 | 5 | 0.10 | 0.13 | Ex. |
| 43 | II | c | 8 | e | 8 | 5 | 5 | 0.09 | 0.12 | |
| 44 | II | c | 11 | e | 11 | 5 | 5 | 0.09 | 0.11 | |
| 45 | II | c | 17 | e | 17 | 3 | 3 | 0.12 | 0.16 | Comp. Ex. |
| 46 | II | d | 5 | b | 5 | 5 | 5 | 0.09 | 0.11 | Ex. |
| 47 | II | d | 8 | b | 8 | 5 | 5 | 0.09 | 0.12 | |
| 48 | II | d | 11 | b | 11 | 5 | 5 | 0.10 | 0.12 | |

TABLE 6-continued

| Test No. | Annealing conditions (symbol) | First electrolysis treatment: Electrolyte solution | First electrolysis treatment: Electrolysis conditions | Second electrolysis treatment: Electrolyte solution | Second electrolysis treatment: Electrolysis conditions | Descaling: Acid pickling solution M | Descaling: Acid pickling solution N | Surface roughness*: Acid pickling solution M | Surface roughness*: Acid pickling solution N | Remarks |
|---|---|---|---|---|---|---|---|---|---|---|
| 49 | II | d | 17 | b | 17 | 3 | 3 | 0.11 | 0.16 | Comp. Ex. |
| 50 | II | — | — | — | — | 1 | 1 | — | — | Comp. Ex. |

Ex.: Example of the present invention
Comp Ex.: Comparative Example
*Ra (μm)

TABLE 7

| Test No. | Annealing conditions (symbol) | First electrolysis treatment: Electrolyte solution | First electrolysis treatment: Electrolysis conditions | Second electrolysis treatment: Electrolyte solution | Second electrolysis treatment: Electrolysis conditions | Descaling: Acid pickling solution M | Descaling: Acid pickling solution N | Surface roughness*: Acid pickling solution M | Surface roughness*: Acid pickling solution N | Remarks |
|---|---|---|---|---|---|---|---|---|---|---|
| 51 | III | d | 6 | e | 18 | 5 | 5 | 0.13 | 0.16 | Ex. |
| 52 | III | d | 9 | e | 12 | 5 | 5 | 0.12 | 0.15 | |
| 53 | III | d | 12 | e | 9 | 5 | 5 | 0.12 | 0.15 | |
| 54 | III | d | 18 | e | 6 | 5 | 5 | 0.13 | 0.17 | |
| 55 | III | — | — | — | — | 1 | 1 | — | — | Comp. Ex. |
| 56 | IV | d | 6 | f | 18 | 5 | 5 | 0.13 | 0.18 | Ex. |
| 57 | IV | d | 9 | f | 12 | 5 | 5 | 0.12 | 0.14 | |
| 58 | IV | d | 12 | f | 9 | 5 | 5 | 0.13 | 0.16 | |
| 59 | IV | d | 18 | f | 6 | 5 | 5 | 0.13 | 0.17 | |
| 60 | IV | — | — | — | — | 1 | 1 | — | — | Comp. Ex. |
| 61 | V | a | 6 | d | 18 | 5 | 5 | 0.15 | 0.20 | Ex. |
| 62 | V | a | 9 | d | 12 | 5 | 5 | 0.14 | 0.18 | |
| 63 | V | a | 12 | d | 9 | 5 | 5 | 0.13 | 0.17 | |
| 64 | V | a | 18 | d | 6 | 5 | 5 | 0.14 | 0.19 | |
| 65 | V | — | — | — | — | 1 | 1 | — | — | Comp. Ex. |
| 66 | VI | b | 6 | e | 18 | 5 | 5 | 0.15 | 0.20 | Ex. |
| 67 | VI | b | 9 | e | 12 | 5 | 5 | 0.14 | 0.18 | |
| 68 | VI | b | 12 | e | 9 | 5 | 5 | 0.15 | 0.19 | |
| 69 | VI | b | 18 | e | 6 | 5 | 5 | 0.15 | 0.21 | |
| 70 | VI | — | — | — | — | 1 | 1 | — | — | Comp. Ex. |

Ex.: Example of the present invention
Comp. Ex.: Comparative Example
*Ra (μm)

As is apparent from these tables, in the examples of the present invention, no remaining scale was observed on the descaled test pieces even under an optical microscope. Also, a considerable amount of scale was observed, under an optical microscope, on the test pieces which had been subjected to cathodic electrolysis alone. Surface roughness Ra was 0.08–0.21 μm. By contrast, in the case where electrolysis was omitted, a large amount of remaining scale was observed with the naked eye.

In order to perform complete descaling in the case where electrolysis was omitted, the test pieces were subjected to acid pickling by use of a nitric-hydrofluoric acid pickling solution under the following conditions: acid pickling solution: 10 mass % $HNO_3$–3 mass % HF; 50° C.; time of immersion: 180 seconds. The results are shown in Table 8.

TABLE 8

| Test No. | Annealing conditions (symbol) | Conditions of nitric-hydrofluoric acid pickling | Degree of Descaling | Surface roughness Ra (μm) | Remarks |
|---|---|---|---|---|---|
| 71 | I | Acid pickling solution: | 5 | 1.03 | Comparative Example |
| 72 | II | 10 mass % $HNO_3$- | 5 | 1.10 | |
| 73 | III | 3 mass % HF | 5 | 1.22 | |
| 74 | IV | Temperature of | 5 | 1.25 | |
| 75 | V | solution: 50° C. | 5 | 1.38 | |
| 76 | VI | Time of immersion: 180 seconds | 5 | 1.51 | |

As is apparent from Table 8, scale was completely removed through increase of the HF concentration and extension of time for immersion. However, the surface roughness Ra became 1.03–1.51 μm, resulting in significantly rough surfaces due to acid pickling.

Under "Electrolysis conditions" of Table 5, alternate electrolysis was limited to a manner in which anodic electrolysis was performed after cathodic electrolysis. However, another descaling test revealed that descaling performance showed no difference if alternate electrolysis was performed in a manner that cathodic electrolysis was performed after anodic electrolysis, resulting in no remaining scale observed on the test pieces after descaling under an optical microscope.

Example 2

Cold-rolled strips of commercial Pure Titanium A of Table 1 and Industrial Titanium Alloy E of Table 1 were annealed in a 100% $N_2$ atmosphere by use of a successive annealing furnace which can control the concentrations of a variety of gasses for constituting an atmosphere.

Also, cold-rolled strips in the form of a coil prepared from commercial Pure Titanium A of Table 1 and Titanium Alloy C of Table 1 were annealed in a 95% $N_2$+5% $H_2$ atmosphere by use of a batch annealing furnace. Table 9 shows the results of measurement of the thickness of scale which was produced by annealing under these conditions.

TABLE 9

| Symbol | Test material (symbol) | Annealing temperature (° C.) | Heating time (min.) | Annealing furnace | Annealing atmosphere (% by volume) | Thickness of scale (nm) |
|---|---|---|---|---|---|---|
| VII | A | 700 | 2.5 | Successive-type furnace | 100% $N_2$ | 89 |
| VIII | E | 710 | 1.0 | | | 115 |
| IX | A | 700 | 300 | Batch-type furnace | 95% $N_2$ + 5% $H_2$ | 187 |
| X | C | 780 | 360 | | | 275 |

As in the case of Example 1, the thickness of scale was calculated from the weight of scale peeled from the test piece according to the bromide-methanol method.

Next, electrolyte solutions having the compositions and temperatures shown in Table 3 were placed in electrolysis vessels of the indirect current feeding method, and the annealed strips were subjected to electrolysis treatments in these vessels while a variety of electrolysis currents were applied to the vessels.

Subsequently, the strips were subjected to acid pickling by use of a nitric-hydrofluoric acid pickling solution (10 mass % $HNO_3$–1 mass % HF (50° C.)). Also, as Comparative Examples, a group of the coils were directly subjected to acid pickling by the above solution without the electrolysis treatment.

One or two electrolysis vessels were used. In the case where two electrolysis vessels were used, different solutions were placed in the vessels.

Test pieces were cut from the strips after acid pickling, and the degree of remaining scale and average surface roughness were measured according to the evaluation criteria used in Example 1. The results are shown in Table 10.

TABLE 10

| | | Electrolysis vessel 1 | | Electrolysis vessel 2 | | | | |
|---|---|---|---|---|---|---|---|---|
| Test No. | Annealing conditions (symbol) | Electrolyte solution | Total electrolysis current (A) | Electrolyte solution | Total electrolysis current (A) | Degree of Descaling | Surface roughness Ra (μm) | Remarks |
| 77 | VII | c | 500 | — | — | 5 | 0.08 | Ex. |
| 78 | VII | c | 1200 | — | — | 5 | 0.08 | |
| 79 | VII | c | 2500 | — | — | 5 | 0.07 | |
| 80 | VII | — | — | a | 500 | 5 | 0.08 | |
| 81 | VII | — | — | a | 1200 | 5 | 0.07 | |
| 82 | VII | — | — | a | 2500 | 5 | 0.07 | |
| 83 | VII | c | 800 | a | 800 | 5 | 0.08 | |
| 84 | VII | c | 2000 | a | 2000 | 5 | 0.07 | |
| 85 | VII | — | — | — | — | 1 | — | Comp. Ex. |
| 86 | VIII | e | 700 | c | 700 | 5 | 0.08 | Ex. |
| 87 | VIII | e | 1400 | c | 1400 | 5 | 0.10 | |
| 88 | VIII | e | 2100 | c | 2100 | 5 | 0.09 | |
| 89 | VIII | — | — | — | — | 1 | — | Comp. Ex. |
| 90 | IX | d | 600 | c | 600 | 5 | 0.12 | Ex. |
| 91 | IX | d | 1200 | c | 1200 | 5 | 0.12 | |
| 92 | IX | d | 1800 | c | 1800 | 5 | 0.12 | |
| 93 | IX | — | — | — | — | 1 | — | Comp. Ex. |
| 94 | X | e | 800 | c | 800 | 5 | 0.15 | Ex. |
| 95 | X | e | 1600 | c | 1600 | 5 | 0.18 | |
| 96 | X | e | 2400 | c | 2400 | 5 | 0.169 | |
| 97 | X | — | — | — | — | 1 | — | Comp. Ex. |

Ex.: Example of the present invention
Comp. Ex.: Comparative Example

As is apparent from Table 10, in the Examples of the present invention, no remaining scale was observed on the descaled test pieces even under an optical microscope. The average surface thickness Ra was 0.07–0.18 μm. On the other hand, in the case of the Comparative Examples, which were descaled only through acid pickling, a large amount of remaining scale was observed with the naked eye.

Example 3

Cold-rolled strips of cmmercial Pure Titanium A of Table 1, commercial Pure Titanium B of Table 1, and Industrial Titanium Alloy E of Table 1 were successively annealed by use of a tunnel-type combustion heating furnace which uses a hydrocarbon gas as fuel. Subsequently, the strips were subjected to a treatment in which the strips were immersed in a fused alkaline salt bath of the following composition at 480° C. for 10 seconds, and washed with water.

Sodium nitrate: 10.2% by mass

Sodium chloride: 8.3% by mass

Sodium carbonate: 2.5% by mass

Remainder: Sodium hydroxide

Table 11 shows the annealing atmosphere, annealing temperature, heating time during annealing, and the thickness of scale generated on the surface of titanium under annealing in each case. However, the test material represented by symbol XII of Table 11 was not immersed in a fused alkaline salt bath.

TABLE 11

| Symbol | Test material (symbol) | Annealing temperature (° C.) | Heating time (min.) | Annealing atmosphere (% by volume) | Thickness of scale (nm) |
|---|---|---|---|---|---|
| X I | A | 800 | 3.5 | 74.5% $N_2$ + | 556 |
| X II | B | 725 | 2.0 | 11% $CO_2$ + | 337 |
| X III | E | 780 | 3.5 | 11% $H_2O$ + 3.5% $O_2$ | 508 |

Next, test pieces (100 mm wide×150 mm length) were cut from the annealed strips, and subjected to electrolysis under the conditions shown in Table 12 by use of electrolyte solutions having compositions and temperatures (a, c, and d) shown in Table 3. Subsequently, the test pieces were immersed in a nitric-hydrofluoric acid pickling solution of the following composition at 50° C. for 60 seconds, washed with water, and dried.

TABLE 12

| Symbol | Cathodic electrolysis: Current density ($A/dm^2$) | Cathodic electrolysis: Time (s) | Anodic electrolysis: Current density ($A/dm^2$) | Anodic electrolysis: Time (s) | Number of repetitions | Remarks |
|---|---|---|---|---|---|---|
| ① | — | — | 20 | 30 | 1 | Only anodic electrolysis |
| ② | — | — | 30 | 20 | 1 | |
| ③ | — | — | 40 | 15 | 1 | |
| ④ | 20 | 2 | 20 | 2 | 15 | Alternate electrolysis (sequentially from cathodic electrolysis to anodic electrolysis) |
| ⑤ | 30 | 3 | 30 | 3 | 6 | |
| ⑥ | 40 | 2 | 20 | 4 | 10 | |
| ⑦ | 40 | 2 | 20 | 4 | 10 | Alternate electrolysis (sequentially from anodic electrolysis to cathodic electrolysis) |

Nitric acid: 10% by mass hydrofluoric acid: 1% by mass

The thus-obtained test pieces were measured for degree of remaining scale and average surface roughness according to the evaluation criteria used in Example 1. The results are shown in Table 13.

TABLE 13

| Test No. | Annealing conditions (symbol) | Fused alkali treatment | Electrolyte solution | Condition of electrolysis | Degree of descaling | Surface roughness Ra (μm) | Remarks |
|---|---|---|---|---|---|---|---|
| 98 | XI | Performed | a | ① | 5 | 0.10 | Example of the present invention |
| 99 | XI | " | a | ② | 5 | 0.10 | |
| 100 | XI | " | a | ③ | 5 | 0.09 | |
| 101 | XI | " | a | ④ | 5 | 0.10 | |
| 102 | XI | " | a | ⑤ | 5 | 0.10 | |
| 103 | XI | " | a | ⑥ | 5 | 0.09 | |
| 104 | XI | " | a | ⑦ | 5 | 0.10 | |
| 105 | XI | " | — | — | 2 | — | Comp. Ex. |
| 106 | XI | Not performed | — | — | 1 | — | |
| 107 | XII | " | c | ① | 5 | 0.10 | Example of the present invention |
| 108 | XII | " | c | ② | 5 | 0.11 | |
| 109 | XII | " | c | ③ | 5 | 0.11 | |
| 110 | XII | " | a | ④ | 5 | 0.09 | |
| 111 | XII | " | a | ⑤ | 5 | 0.10 | |
| 112 | XII | " | a | ⑥ | 5 | 0.10 | |
| 113 | XII | " | a | ⑦ | 5 | 0.11 | |
| 114 | XII | " | — | — | 1 | — | Comp. Ex. |
| 115 | XIII | Performed | c | ① | 5 | 0.10 | Example of the present invention |
| 116 | XIII | " | c | ② | 5 | 0.11 | |
| 117 | XIII | " | c | ③ | 5 | 0.10 | |
| 118 | XIII | " | d | ④ | 5 | 0.09 | |
| 119 | XIII | " | d | ⑤ | 5 | 0.09 | |
| 120 | XIII | " | d | ⑥ | 5 | 0.10 | |
| 121 | XIII | " | d | ⑦ | 5 | 0.09 | |
| 122 | XIII | " | — | — | 2 | — | Comp. Ex. |
| 123 | XIII | Not performed | — | — | 1 | — | |

Comp. Ex.: Comparative Example
*Ra (μm)

As is apparent from Table 13, in the Examples of the present invention, no remaining scale was observed on the descaled test pieces under an optical microscope, and the surface roughness Ra was 0.09–0.11 11 m. On the other hand, in the case of the test pieces which were subjected to a fused alkaline salt bath treatment without an electrolysis treatment (Test Nos. 105 and 122), a considerable amount of remaining scale was observed with the naked eye, and in the case of the test pieces which were subjected to neither a fused alkaline salt bath treatment nor an electrolysis treatment (Test Nos. 106, 114 and 123), a large amount of remaining scale was observed with the naked eye (Substantially no descaling was performed). The surface of the titanium material was observed with the naked eye after a fused alkaline salt bath treatment; however, no generation of sparks was confirmed.

The descaling method of the present invention enables reliable removal of oxide scale generated on the surface of titanium and titanium alloy without causing spark flaws, which are unavoidable in a conventional fused alkaline salt bath method. Also, according to the descaling method of the present invention, the consumption of acid pickling solution required for descaling and the amount of sludge produced in waste acids treatment can be reduced as compared with the conventional method. Further, the descaling method has significantly great value in terms of industrial application, since the descaling method provides products having a low surface roughness and excellent gloss without use of a fused alkaline salt bath, even if the thickness of scale is relatively small.

What is claimed is:

1. A method of descaling titanium material, comprising the steps of:

subjecting titanium material having oxide scale on a surface thereof to anodic electrolysis or alternate electrolysis in an electrolyte solution which is an oxidizing aqueous solution free of fluorine acid so as to dissolve the oxide scale; and subjecting the titanium material to acid pickling so as to remove remaining oxide scale or oxide film generated in the electrolysis.

2. A method of descaling titanium material, comprising the steps of: immersing titanium material having oxide scale on a surface thereof in a fused alkaline salt bath so as to dissolve a portion of the scale; subjecting the titanium material to anodic electrolysis or alternate electrolysis in an electrolyte solution which is an oxidizing aqueous solution free of fluorine acid so as to dissolve the oxide scale; and subjecting the titanium material to acid pickling so as to remove remaining oxide scale or oxide film generated in the electrolysis.

3. A method of descaling titanium material according to claim 1, wherein current density in the electrolysis is 0.5–50 $A/dm^2$.

4. A method of descaling titanium material according to claim 2, wherein current density in the electrolysis is 0.5–50 $A/dm^2$.

5. A method of descaling titanium material according to claim 1, wherein the oxidizing aqueous acidic solution contains nitric acid.

6. A method of descaling titanium material according to claim 2, wherein the oxidizing aqueous acidic solution contains nitric acid.

7. A method of descaling titanium material according to claim 1, wherein the alternate electrolysis is performed, such that the period of time for anodic electrolysis is longer than that for cathodic electrolysis.

8. A method of descaling titanium material according to claim 2, wherein the alternate electrolysis is performed, such that the period of time for anodic electrolysis is longer than that for cathodic electrolysis.

9. A method of descaling titanium material according to claim 1, wherein the potential during anodic electrolysis is 2 to 20 V (vs. SCE).

10. A method of descaling titanium material according to claim 2, wherein the potential during anodic electrolysis is 2 to 20 V (vs. SCE).

11. Titanium material having annealed structure, which has a surface finished by acid pickling and which has a surface roughness of less than 0.50 $\mu$m as represented by Ra and which has a surface in which grains are distinguishable by observing the surface with a microscope.

* * * * *